US007094001B2

(12) United States Patent
Wills

(10) Patent No.: US 7,094,001 B2
(45) Date of Patent: Aug. 22, 2006

(54) CONTROLLING EMISSIONS DURING ASPHALT PAVING

(75) Inventor: Michael K. Wills, La Quinta, CA (US)

(73) Assignee: Granite Construction Company, Indio, CA (US)

( * ) Notice: Subject to any disclaimer, the term of this patent is extended or adjusted under 35 U.S.C. 154(b) by 0 days.

(21) Appl. No.: 10/664,226

(22) Filed: Sep. 16, 2003

(65) Prior Publication Data

US 2005/0058506 A1 Mar. 17, 2005

(51) Int. Cl.
*E01C 7/06* (2006.01)

(52) U.S. Cl. ..... 404/75; 422/5

(58) Field of Classification Search ..... 405/128.15, 405/128.25, 128.75; 404/75, 76; 222/1; 422/5; 423/245.2

See application file for complete search history.

(56) References Cited

U.S. PATENT DOCUMENTS 3,724,173 A * 4/1973 Fry, Sr. ..... 95/196
3,969,479 A * 7/1976 Lonnes et al. ..... 423/210
5,297,893 A 3/1994 Corcoran et al. ..... 404/72
5,342,143 A * 8/1994 Corcoran et al. ..... 404/72
5,352,275 A * 10/1994 Nath et al. ..... 95/117
5,470,176 A 11/1995 Corcoran et al. ..... 404/72

FOREIGN PATENT DOCUMENTS

JP 2000-319657 * 11/2000

* cited by examiner

*Primary Examiner*—Gary S. Hartmann
(74) *Attorney, Agent, or Firm*—DLA Piper Rudnick Gray Cary US LLP

(57) ABSTRACT

The invention is a method and system for controlling emissions, such as malodorous emissions that form during asphalt paving. The method includes spraying an emission-causing substance (such as an asphalt substance) on a surface while moving over the surface, and releasing a liquid agent so that molecules of the liquid agent mix with molecules of the emission-causing substance. The liquid agent is pressurized to about 200–600 psia before being released, and therefore forms a mist. This mist mixes with the emission-causing substance either on the surface or in the air space above the surface. The system of the invention includes a first outlet for supplying an asphalt substance, wherein the outlet is attached to a vehicle, and a second outlet for releasing a liquid agent, wherein the second outlet is positioned to mix odor-controlling molecules with asphalt substance molecules.

5 Claims, 2 Drawing Sheets

CONTROLLING EMISSIONS DURING ASPHALT PAVING

FIELD OF THE INVENTION

The invention relates generally to asphalt paving and more specifically to asphalt chipsealing.

BACKGROUND

Since automobiles are a primary mode of transportation for many people today, paving the roads to keep them in a good condition has become increasingly important. Among the suitable paving materials, asphalt and asphalt mixtures such as asphalt-rubber mixtures and asphalt-polymer mixtures are popular for their physical properties. The rubber-asphalt mixture, which contains recycled crumb rubber mixed into asphalt, is especially popular because it provides a use for scrap tires, which can pile up and become an environmental problem.

To form the rubber-asphalt, scrap tires are mixed with paving grade liquid asphalt at a temperature of approximately 400° F. The resulting liquid is then sprayed onto a surface at 385–400° F. or used as a binder in hot mix asphalt. When the hot rubber-asphalt molecules come in contact with the air and the road surface, both of which are much cooler than the rubber-asphalt, a thick cloud of emissions is released into the air. The amount of emissions is especially large for rubber-asphalt compared to other types of asphalt paving materials. Although emissions from the spraying of rubber-asphalt mixtures have not been proven to have significant health effects, they adversely affect the atmospheric air quality.

This adverse effect of rubber-asphalt paving can be reduced by installing a vacuum hood in a paving truck. The vacuum hood inlet is located near where the rubber-asphalt is sprayed, and is thereby able to suck up a lot of the emissions. The emissions are then filtered before being released back into the atmosphere.

Although the vacuum pump system helps reduce the amount of emissions released into the atmosphere, installation of a full vacuum pump system on a paving truck can be costly. Furthermore, the filter system has to be changed periodically for the vacuum pump system to work. If the filter system is not changed in time, it could result in the release of the emissions back into the atmosphere. Thus, an alternative method/system that does not have these disadvantages is desired.

SUMMARY OF THE INVENTION

The invention is a method and a system for controlling emissions, such as malodorous emissions that form during asphalt paving. The method includes spraying an emission-causing substance, such as an asphalt substance, on a surface while moving over the surface, and releasing a liquid agent so that the molecules of the liquid agent mix with the particles in the emission. The liquid agent is released in the form of a mist to enhance the mixing. In some embodiments, a blower system may be used to help the mixing and to direct the mist in a desired direction. In yet another embodiment, the liquid agent is mixed with the asphalt substance, and the mixture is released onto a surface.

The system of the invention includes a first outlet for supplying an asphalt substance, wherein the outlet is attached to a vehicle, and a second outlet for releasing a liquid agent, wherein the second outlet is positioned to mix the liquid agent with the particles in the emissions. In some embodiments, a blower system including a swivel fan is used to aid the mixing.

DETAILED DESCRIPTION OF THE PREFERRED EMBODIMENT(S)

The invention is particularly applicable to asphalt paving and it is in this context that the invention will be described. It will be appreciated, however, that the emission control system and method in accordance with the invention has greater utility since the system and method may be used in other types of situations that require emission control and/or odor control.

As used herein, "hot" refers to a conventional temperature that is used for asphalt paving, for example 385–400° F. for paving rubber-asphalt. As used herein, "emissions" refers to any environmentally harmful substance, including odor and smoke. In the context of asphalt paving, "emission" includes any environmentally harmful substance that is produced when a hot asphalt substance comes in contact with air or ground that is at a cooler temperature.

Figure 1:
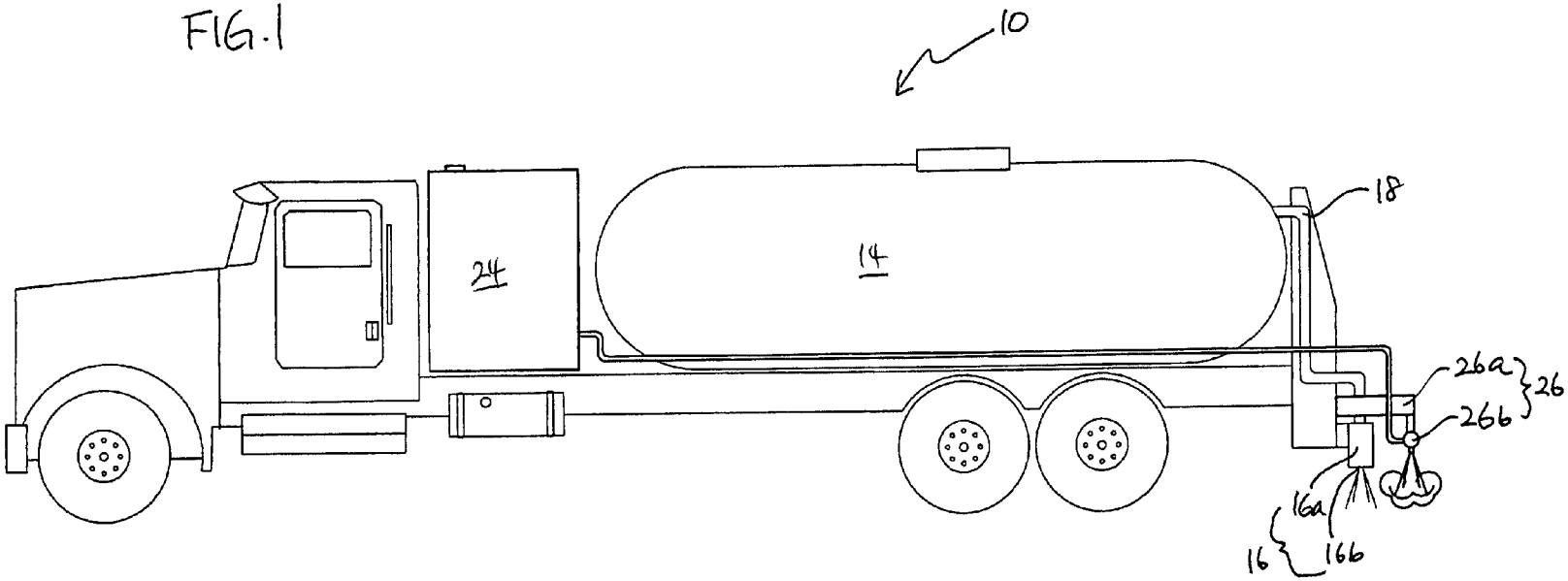
FIG. 1 is a side view of an asphalt paving system equipped with a first embodiment of an emission control system in accordance with the present invention.

FIG. 1 is a side view of an asphalt paving system 10 equipped with a first embodiment of an emission control system 20 in accordance with the present invention. The asphalt paving system 10 typically includes a vehicle that moves across a surface to be paved, such as the truck shown in FIG. 1. The paving vehicle of the type shown in FIG. 1 that is used for general asphalt paving and asphalt chipsealing, but which does not include the emission control system of the invention, is well known in the industry. In addition, the asphalt paving system 10 includes an asphalt substance storage tank 14, an asphalt substance distribution system 16 such as a well known spray bar, and a first pipe 18 through which the asphalt substance flows to reach the asphalt substance distribution system 16. The asphalt substance storage tank 14 includes one or more mechanisms for mixing the content, such as the well known screw auger and/or agitator, and a recycling system.

The emission control system 20 includes a liquid agent storage tank 24, a liquid agent distribution system 26 such as a well known spray bar, and a second pipe 28 that carries the liquid agent from the storage tank 24 to the distribution system 26. The liquid agent storage tank 24 preferably includes a pump that pressurizes the liquid agent, which is in liquid form. The liquid agent, which may be pressurized to about 200–600 psia, becomes a mist upon being released into the atmosphere through the liquid agent distribution system 26. A "mist," as used herein, refers to small droplets of liquid suspended in air.

The rate at which the asphalt substance is deposited may be about two orders of magnitude greater than the rate at which the liquid agent is released. For example, when depositing 2200–2800 gallons/hr of the asphalt substance, the liquid agent may be released at 15–25 gallons/hr. The optimum rate of release for the two substances depends on the type of asphalt mixture being used and the concentration of the liquid agent. A person of ordinary skill in the art will know to adjust the rates of release for optimum result. The rate of release may be controlled from a control panel located inside the vehicle.

Figure 2:
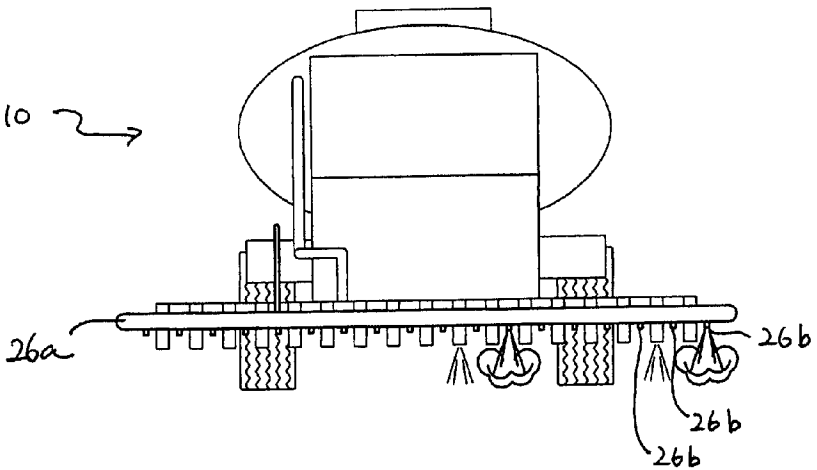
FIG. 2 is a back view of the asphalt paving system that is shown in FIG. 1.

FIG. 2 is a back view of the asphalt paving system 10 that is shown in FIG. 1. As shown, the asphalt substance distribution system 16 includes a first distribution bar 16*a* that has nozzles 16*b* positioned along it. The first distribution bar 16*a*, which preferably extends across the entire width of the road being paved, is typically about 5 ft.–20 ft. wide. The nozzles 16*b* are shaped to "spray" out the liquid asphalt substance and evenly coat the surface of the road. In an exemplary embodiment, there are a plurality of nozzles 16*b* placed along the asphalt substance distribution bar 16*a*. For example, there may be 6–10 nozzles with 6" centers. The nozzles may be individually controllable or controlled as a group. A person of ordinary skill in the art will understand that many variations of the nozzles 16*b* are possible, all of which are within the scope of the invention.

The liquid agent distribution system 26 includes a second distribution bar 26*a* that has outlets 26*b* located thereon. The first distribution bar 16*a* and the second distribution bar 26*a* are positioned with respect to each other so as to maximize the mixing of the liquid agent and particles in the emissions. In an exemplary embodiment, the second distribution bar 26*a* is positioned near the first distribution bar 16*a* (e.g., about 6" behind the distribution bar 16*a*). The width of the second distribution bar 26*a* is adjustable.

An "asphalt substance," as used herein, includes straight asphalt or any mixture that includes asphalt, such as a mixture of asphalt and crumb rubber or a mixture of asphalt and polymer. Thus, the utility of the invention described herein is not limited to a specific type of asphalt or asphalt mixture.

The liquid agent is any substance that is known to control odor and/or smoke and is deemed suitable by a person of ordinary skill in the art. For example, the liquid agent may be the commercially available Ecosorb Natural Organic Neutralizer from Odor Management, Inc. and Cherry Odor Neutralizer from Tri-Star. The Cherry Odor Neutralizer contains one or more of alkyl dimethyl benzyl ammonium chloride, alkyl dimethyl ethyl benzyl ammonium chloride, and cherry oil. The Ecosorb Natural Organic Neutralizer, which also includes plant oil, neutralizes odor by forming a thin oil-based film over water droplets, creating an electrostatic charge that attracts the odorous molecules. The Ecosorb molecules remain airborne until the droplet is saturated with the smoke/odor molecules, at which point they fall to the ground. Besides these two commercially available products, various types of lipids may be used as the liquid agent. "Lipids," as used herein, describe a group of natural substances that are soluble in hydrocarbons but not in water, such as plant oils. Various biocides may also be used as the liquid agent.

The liquid agent may be mixed with water to achieve the desired properties. Although using undiluted liquid agent is effective for controlling emissions, dilution may be preferable for cost-related reasons. Furthermore, if the liquid agent being used is scented, like the Cherry Odor Neutralizer, dilution may be desirable to prevent the pavement from smelling like the liquid agent. The invention is not limited to a specific concentration of liquid agent. However, a water-to-liquid-agent volumetric ratio of between about 10:1 and about 50:1 have been shown to reduce emissions at a reasonable cost.

Figure 3:
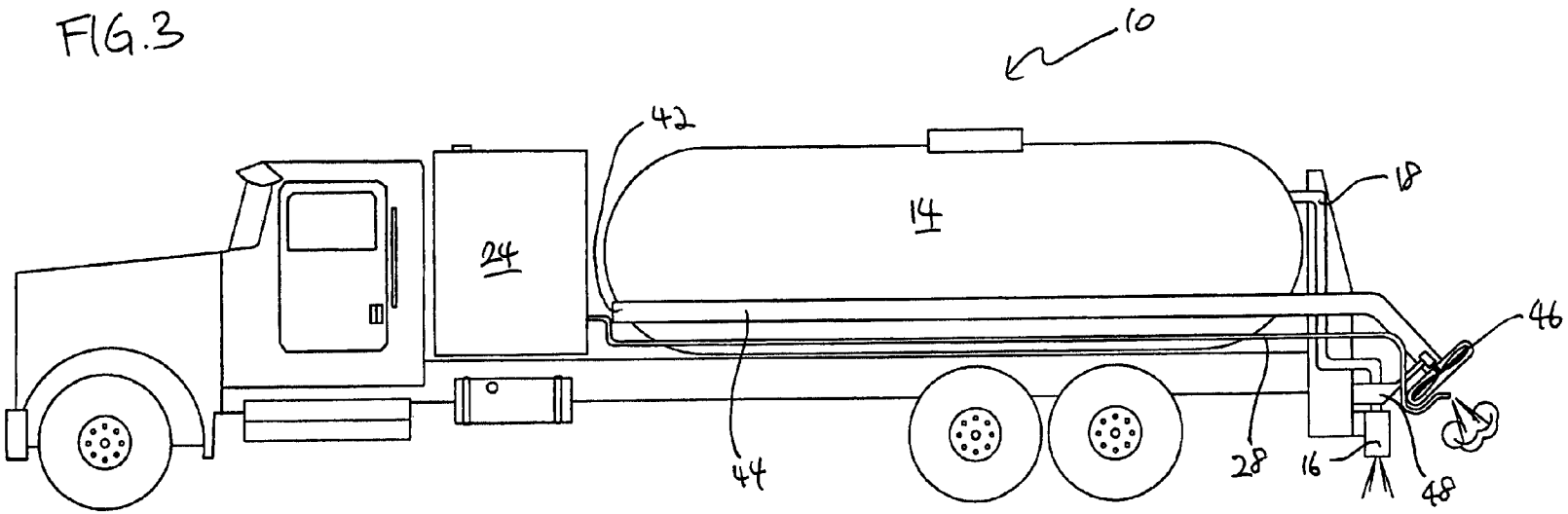
FIG. 3 is a side view of an asphalt paving system equipped with a second embodiment of an emission control system in accordance with the present invention.

FIG. 3 is a side view of an asphalt paving system 10 equipped with a second embodiment of an emission control system 20 in accordance with the present invention. The second embodiment is similar to the first embodiment in that it includes substantially all the elements of the first embodiment, which are described above. In addition, however, the second embodiment also includes a blower system 40 that is not part of the first embodiment. The blower system 40 directs a gas stream (e.g., air) towards the liquid agent molecules coming out of the nozzles 26*b* (shown in FIG. 2), helping their dispersion and preventing the nozzles 26*b* from becoming clogged with particles from the smoke that is emitted when the asphalt substance touches the ground. The blower system 40 includes a gas inlet 42, a blower pipe 44, and one or more fans 46. The fans 46 are driven by a local motor 48 that is connected to the fans 46.

Although only one second pipe 28 is shown in FIG. 3 in the interest of clarity, there may in fact be one second pipe 28 for each nozzle 26*b*. Alternatively, a single second pipe 28 may divide to form multiple outlets near the fans 46.

Figure 4:
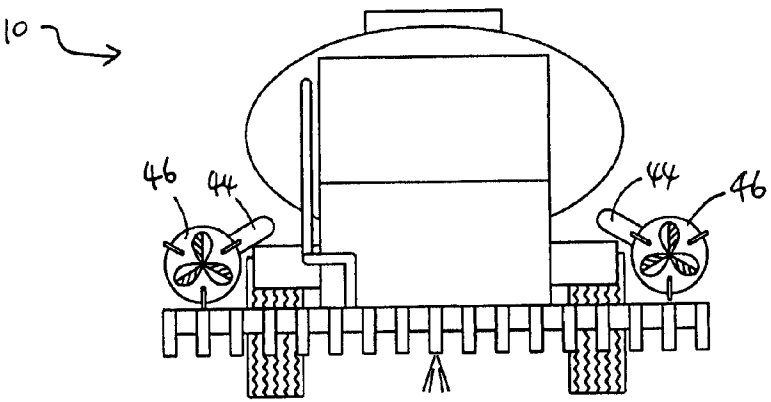
FIG. 4 is a back view of the asphalt paving system of FIG. 3.

FIG. 4 is a back view of the asphalt paving system of FIG. 3. The embodiment that is shown has two fans 46 that are located near the two rear corners of the vehicle 10. In the particular embodiment, the nozzles 26*b* are arranged in a circular pattern near each of the fans 46. The gas inlet 42 is preferably located near the front of the vehicle to ensure that the intake air is free of emissions. The fans 46 may be connected to a vertically and horizontally adjustable swivel, allowing the air to be directed in a desired direction depending on the location of the asphalt substance nozzles 16*b* and the liquid agent nozzles 26*b*. Each of the fans 46 may be about 2 ft. in diameter, although the invention is not so limited.

In yet another embodiment, the liquid agent is mixed with the asphalt substance in a tank before being sprayed onto the surface. Either the asphalt paving system 10 of FIG. 1 or the asphalt paving system 10 of FIG. 3 can be used for this embodiment. The liquid agent and the asphalt substance may be mixed together in the asphalt substance storage tank 14. A relatively small amount of liquid agent is used for emissions control. For example, a 6500-gallon mixture of asphalt substance and liquid agent may only contain 5 gallons of liquid agent. Optionally, water may be added to the mixture.

While the foregoing has been with reference to particular embodiments of the invention, it will be appreciated by those skilled in the art that changes to these embodiments may be made without departing from the principles and spirit of the invention, the scope of which is defined by the appended claims.

What is claimed is:

1. A method of controlling emissions during asphalt paving, the method comprising:

spraying an asphalt substance on a surface while moving over the surface, wherein the asphalt substance produces emissions; and releasing a liquid agent so that molecules of the liquid agent mix with particles in the emissions to reduce at least one of smoke and odor; and pressurizing the liquid agent to about 200–600 psia, so that the liquid agent forms a mist upon being released.

2. The method of claim 1 further comprising spraying the asphalt substance at a rate that is approximately two orders of magnitude greater than the rate of releasing the liquid agent.

3. The method of claim 1 further comprising mixing the liquid agent with water at a volumetric water-to-liquid agent ratio of between about 10:1 and about 50:1.

4. The method of claim 1, wherein the liquid agent comprises at least one of alkyl dimethyl benzyl ammonium chloride, alkyl dimethyl ethyl benzyl ammonium chloride, cherry oil, and water.

5. A method of controlling emissions during asphalt paving, the method comprising:

spraying an asphalt substance on a surface while moving over the surface, wherein the asphalt substance produces emissions; and releasing a liquid agent so that molecules of the liquid agent mix with particles in the emissions to reduce at least one of smoke and odor, wherein the liquid agent comprises a lipid.

* * * * *